US007317439B2

(12) United States Patent
Hata et al.

(10) Patent No.: US 7,317,439 B2
(45) Date of Patent: Jan. 8, 2008

(54) ELECTRONIC APPARATUS AND RECORDING MEDIUM THEREFOR

(75) Inventors: Ryota Hata, Iizuka (JP); Jun Ikeda, Fukuoka (JP); Shuichi Ojima, Fukuoka (JP); Tsuyoshi Hirashima, Fukuoka-Ken (JP); Tadashi Kayada, Yokosuka (JP); Kousuke Kubota, Yokosuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 40 days.

(21) Appl. No.: 10/045,611

(22) Filed: Oct. 25, 2001

(65) Prior Publication Data

US 2002/0105527 A1 Aug. 8, 2002

(30) Foreign Application Priority Data

Oct. 30, 2000 (JP) ..... 2000-329911

(51) Int. Cl.
*G09G 3/36* (2006.01)

(52) U.S. Cl. ..... 345/89; 345/102; 345/690

(58) Field of Classification Search ..... 345/87–102, 345/103, 690, 207
See application file for complete search history.

(56) References Cited

U.S. PATENT DOCUMENTS 6,078,302 A * 6/2000 Suzuki ..... 345/77
6,087,786 A * 7/2000 Allen et al. ..... 315/291
6,094,185 A * 7/2000 Shirriff ..... 345/102
6,144,164 A * 11/2000 Ito ..... 315/169.3
6,144,359 A * 11/2000 Grave ..... 345/102
6,219,021 B1 * 4/2001 Izumi ..... 345/102
6,300,931 B1 * 10/2001 Someya et al. ..... 345/102
6,529,212 B2 * 3/2003 Miller et al. ..... 345/690
6,611,249 B1 * 8/2003 Evanicky et al. ..... 345/102

FOREIGN PATENT DOCUMENTS

| | | | |
|---|---|---|---|
| JP | 11-045078 | A | 2/1999 |
| JP | 11-65531 | A | 3/1999 |
| JP | 11-065537 | A | 3/1999 |
| JP | 2000010068 | | 1/2000 |
| JP | 2000-147455 | A | 5/2000 |
| JP | 2001-125063 | A | 5/2001 |
| WO | WO-99/45714 | A1 | 9/1999 |

* cited by examiner

*Primary Examiner*—Regina Liang
(74) *Attorney, Agent, or Firm*—Darby & Darby P.C.

(57) ABSTRACT

Picture quality on a display screen is corrected in accordance with a change either in image information or in the light state. The electronic apparatus includes a display panel, a lighting means for lighting the display panel, a parameter adjusting means for adjusting a parameter participating in picture quality so as to conform the light state while using variations in the light state of the lighting means as a trigger, a signal correcting means for inputting a display signal and correcting the input display signal in accordance with the adjusted parameter, and a driving means for driving the display panel on the basis of the corrected display signal. The light state is controlled according to the content of a file containing the information to be displayed.

18 Claims, 6 Drawing Sheets

ELECTRONIC APPARATUS AND RECORDING MEDIUM THEREFOR

BACKGROUND OF THE INVENTION

1. Field of the Invention

The present invention relates to an electronic apparatus having a display panel such as an LCD.

2. Description of the Related Art

In recent years, display panels have been widely used chiefly as a portable display device. The panels have been designed to improve view-ability. Japanese Unexamined Patent Publication No. 2000-10068, for example, discloses a technique in which brightness of a display panel is detected with an optical sensor. The output of the optical sensor is used as to automatically adjust the apparent brightness of the display panel.

This technique can bring about suitable brightness and can somewhat improve its view-ability. However, this must use an optical sensor as an indispensable device. Additionally, even if the display panel can show a constant color quality, differences in brightness of the display panel will produce a visually different perception of the same color, as if different from the original color, and will produce poor view-ability. Accordingly, a disadvantage in the conventional technique resides in that an excellent display quality is difficult to obtain.

OBJECTS AND SUMMARY OF THE INVENTION

It is therefore a first object of the present invention to provide an electronic apparatus that has good view-ability and that can show a beautiful display.

It is a second object of the present invention to provide an electronic apparatus capable of showing a more desirable display in accordance with contents to be displayed.

An electronic apparatus according to a first aspect of the present invention includes a display panel, a lighting means for lighting the display panel, a parameter adjusting means for adjusting a parameter participating in picture quality so as to conform the light state while using variations in the light state of the lighting means as a trigger, a signal correcting means for inputting a display signal and correcting the input display signal in accordance with the adjusted parameter, and a driving means for driving the display panel on the basis of the corrected display signal.

With this structure, the parameter participating in the picture quality is adjusted in accordance with the variation in the light state so as to conform the present light state, and the display signal is corrected in accordance with the parameter. Therefore, the light state and the display signal come to always maintain an appropriate relationship, and a beautiful, comfortably viewable display can be obtained.

In an electronic apparatus according to a second aspect of the present invention, the parameter includes information used for tone reproduction curve correction.

With this structure, color tone can be appropriately adjusted under tone reproduction curve correction.

An electronic apparatus according to a third aspect of the present invention includes an image information acquisition means for acquiring image information about a display signal, in which the parameter includes information used for tone reproduction curve correction of at least two of a halftone priority characteristic that gives priority to a middle range and a high range/low range priority characteristic that gives priority to a high range/low range, and, if acquired image information shows that the display signal includes a great amount of middle ranges, the signal correcting means performs tone reproduction curve correction according to the halftone priority characteristic, and, if acquired image information shows that the display signal includes a great amount of high ranges/low ranges, the signal correcting means performs tone reproduction curve correction according to the high range/low range priority characteristic.

With this structure, image information about the display signal is acquired. When a great amount of middle ranges are included, the halftone priority characteristic is used, and more dynamic ranges are allocated to the middle range so as to make a fine display. On the other hand, when a great amount of high ranges/low ranges are included, the high range/low range priority characteristic is used, and more dynamic ranges are allocated by the high range/low range so as to make a high-contrast, clear display.

In an electronic apparatus according to a fourth aspect of the present invention, the image information acquisition means acquires image information from one or both of file extension information and file header information about the display signal.

With this structure, the analysis of an image itself can be omitted, and image information can be acquired from file extension information or file header information with ease and at high speed.

In an electronic apparatus according to a fifth aspect of the present invention, when acquired image information shows an image that includes a great amount of halftone components, the signal correcting means performs tone reproduction curve correction according to the halftone priority characteristic, and, when acquired image information shows an image or text that includes a great amount of high range/low range components, the signal correcting means performs tone reproduction curve correction according to the high range/low range priority characteristic.

With this structure, a high-range still image can be finely displayed, and a lower-tone still image or text can be clearly displayed. In other words, an image can be optimally displayed without special operations by a user.

In an electronic apparatus according to a sixth aspect of the present invention, the parameter includes information about one or more of edge enhancement processing, hue adjustment, color gain adjustment, and white balance adjustment.

With this structure, picture quality can be more finely adjusted through various adjustments.

An electronic apparatus according to a seventh aspect of the present invention includes an area used to store profile information about an apparatus that has generated the display signal, in which the signal correcting means corrects the display signal while taking this profile into account.

With this structure, fidelity is improved by, for example, removing a characteristic peculiar to the apparatus that has generated the display signal while using the profile information about the apparatus, and thereby display quality can be further improved.

An electronic apparatus according to an eighth aspect of the present invention includes an operating means that accepts the operation of a user, and a control means for inputting operational information from the operating means, in which, when operational information is not input continuously during a fixed time, the control means turns off the lighting means, and, with this turn-off as a trigger, causes the parameter adjusting means to adjust the parameter participating in picture quality so as to conform to a light state.

With this structure, power consumption is controlled by turning off the lighting means when operational information is not input during a fixed time, and, in addition, picture quality is adjusted according to the state of being turned off, and therefore, an excellent display quality can also be obtained after the turn-off. This is highly advantageous in a portable electronic apparatus.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
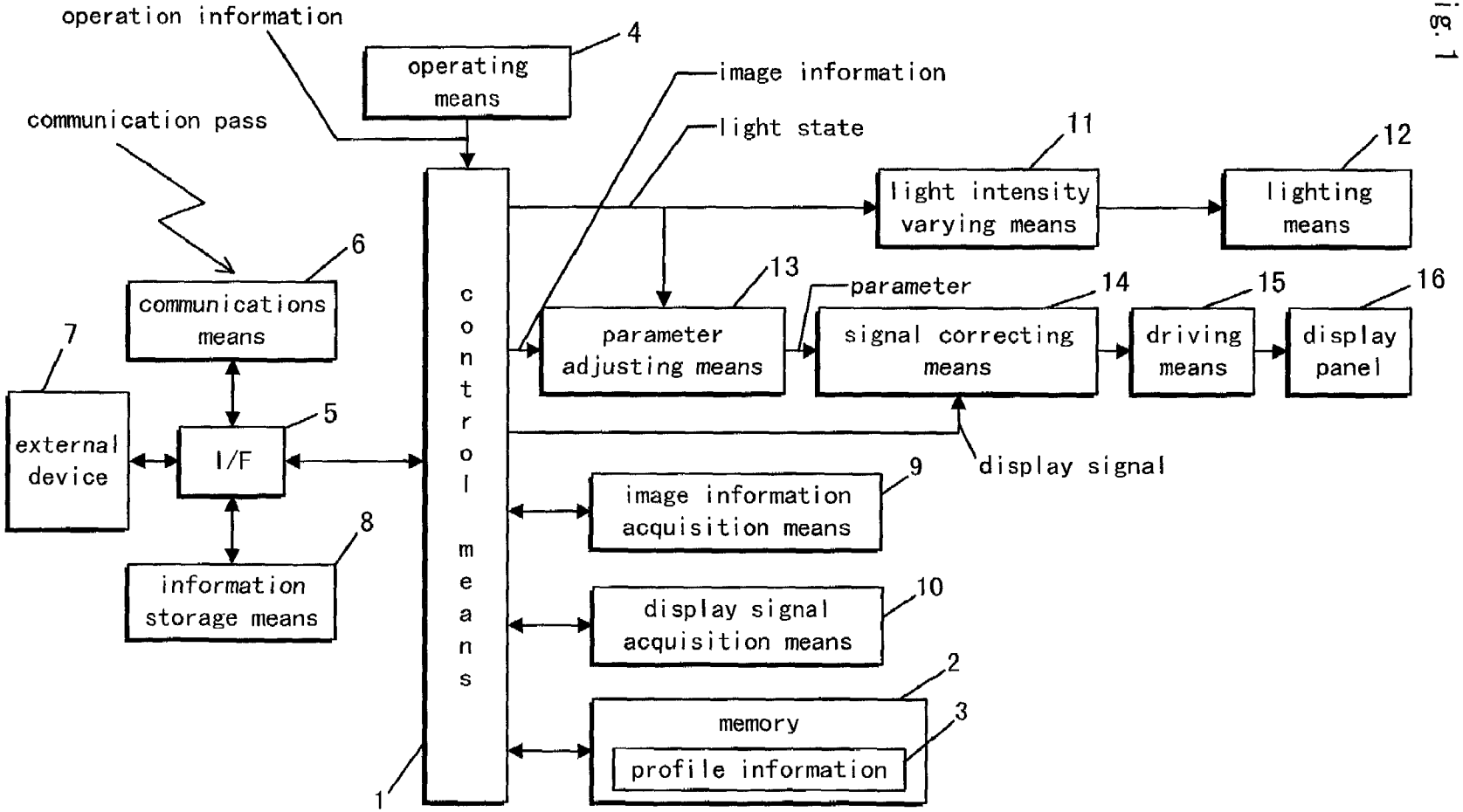
FIG. 1 is a block diagram of an electronic apparatus according to an embodiment of the present invention.

Referring to FIG. 1, a control means 1, controlling the entire apparatus, receives operational information of a user that has been input from an operating means 4. The operating means 4 can be arbitrarily selected from any convenient type of operational-information input device such as, for example, a ten-key keypad, a keyboard, a mouse, or a touch pen.

The control means 1 temporarily reads or writes necessary information from or into a memory 2. The memory 2 has an area 3 that can store profile information about a device (i.e., an external device with reference to the electronic apparatus of the present invention) that has generated a display signal.

In the example of FIG. 1, an interface 5 is connected between the control means 1 to interface it with a communications means 6, an external device 7, and an information storage means 8. The information storage means 8 may be, for example, a tape, hard disk, a CDR or a memory that stores a display signal.

The communications means 6 is connected to other networks to exchange communications by wire or by wireless. As a typical example, the communications means 6 is connected to a provider through a telephone line, and is connected to the Internet via the provider. At this time, the communications means 6 normally takes the form of a modem, a terminal adaptor, or a router. As is well known, various images (in this specification, all contents including a text to be displayed are called "images" in the lump) can be downloaded from each website of the Internet, and the electronic apparatus of the present invention is suitable for displaying them. The reason is that, in spite of the fact that there are various attributes of the images (dynamic image/still image, text, graphics, file format, color system, etc.), the electronic apparatus of the present invention selects an optimum parameter according to these attributes, to obtain a preferred display result.

This does not, of course, mean that usage of the electronic apparatus is limited to the display of downloaded images. On the contrary, it is allowable to design the electronic apparatus as an apparatus that is completely unrelated to the network.

The external device 7, which is, for example, a digital still camera, an image scanner, or a digital video camera, takes a picture of a subject (either a dynamic image or a still image), and outputs a display signal to the electronic apparatus. In this case, if profile information about the external device 7 is obtained, this profile information is stored in the area 3. PD/CD/DVD drives, a digital tuner, or a digital television can also be used as the external device 7.

When the control means 1 receives file input from the communications means 6, the external device 7, or the information storage means 8, an image information acquisition means 9 extracts image information from the file, and outputs it to the control means 1. The image information may be extracted according to file extensions. Alternatively, information about gradation, color system, etc., may be extracted from the header of the file.

In this embodiment, a file extension is used. If the extension is "JPG" (indicating a JPEG image), it is assumed that the file contains a great amount of middle ranges. By contrast, if the extension is "BMP", "GIF", "HTM", or "TXT", it is assumed that an image or a text that includes a great amount of high range/low range components, and that there are a great amount of high ranges/low ranges. If the extension of a dynamic image is attached, this is treated as an indication of the mean without assuming that there are a great amount of middle ranges or that there are a great amount of high ranges/low ranges. However, it is allowable to assume that the dynamic image has a great amount of middle ranges. It is, of course, possible to match extensions other than the above-mentioned ones, or to extract image information from the file header in more detail.

When the control means 1 receives the input of a file from the communications means 6, the external device 7, or the information storage means 8, a display signal acquisition means 10 extracts a display signal from the file, and outputs the display signal to the control means 1.

When a light intensity varying means 11 receives a command about a light state from the control means 1, the light intensity varying means 11 controls a lighting means 12 to emit light in accordance with the command. Herein, if an LCD is used as a display panel 16, a usable type of the lighting means 12 is a transmission type, a reflection type, or a semi-transmission type. Any of these types, and any other convenient types can be used.

A light state and image information are input from the control means 1 to a parameter adjusting means 13. As described in detail later, the parameter adjusting means 13 stores and calculates parameters, which correspond to the input light state and image information that are used for tone reproduction curve correction, and outputs the calculated parameters to a signal correcting means 14. Typically, the parameter adjusting means 13 is made up of registers that store a parameter group.

The signal correcting means 14 inputs a display signal from the control means 1, and inputs a parameter from the parameter adjusting means 13. Also as described in detail later, the signal correcting means 14 corrects the display signal on the basis of the parameter, and outputs it to the driving means 15.

The driving means 15 is made up of a driver for driving the display panel 16 and other elements. The driving means 15 and the display panel 16 are similar to conventional devices. Typically, an LCD is used as the display panel 16. (The light emission method of the LCD is arbitrary. A color display panel is preferable, and a black and white display panel provided with gradations can be used.) It is also possible to use other devices that use a back light or a front light.

Figure 2:
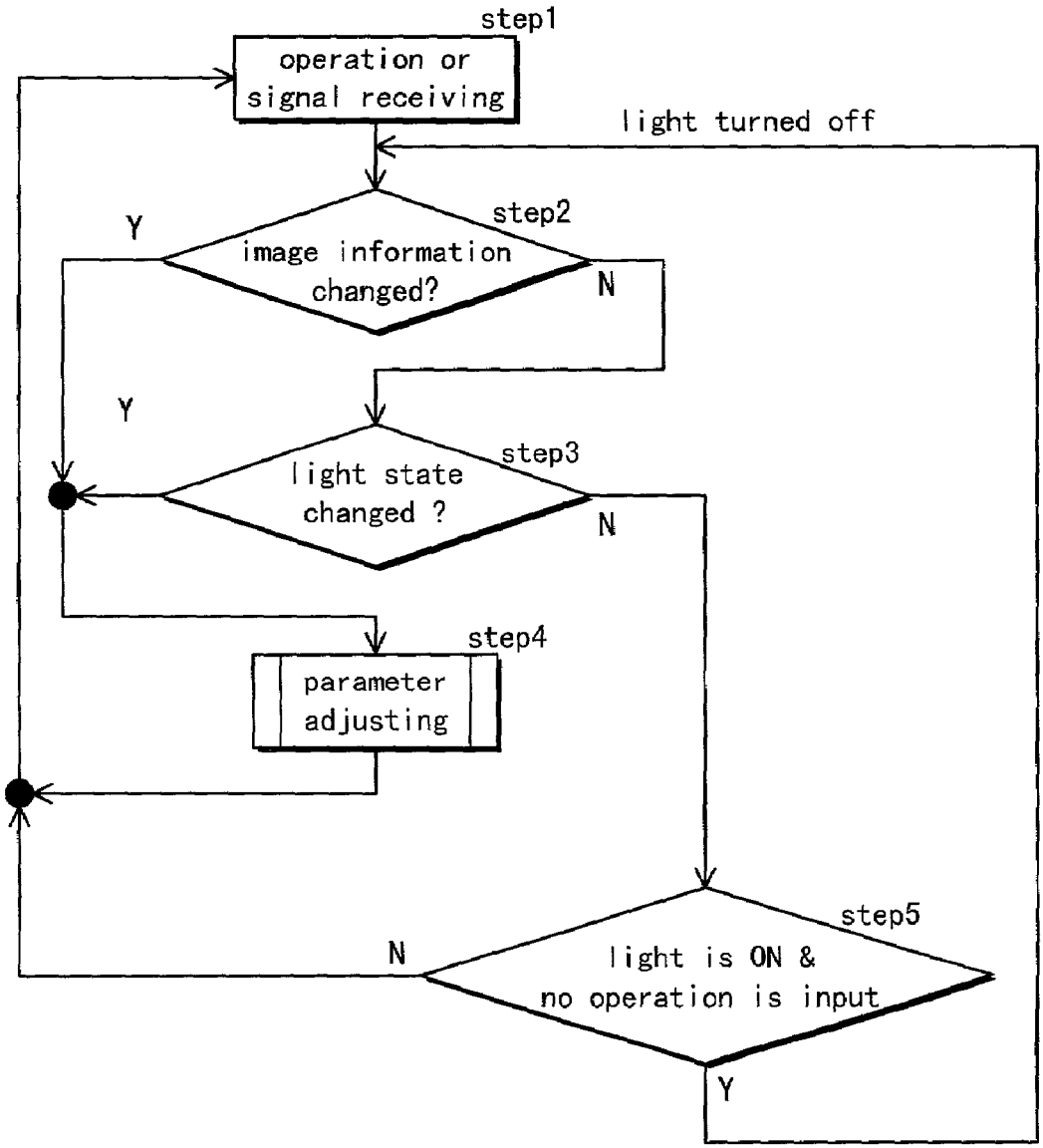
FIG. 2 is a flowchart of the electronic apparatus according to the embodiment of the present invention.

Referring now to FIG. 2, the sequence of operations performed by the control means 1 begins with the control means 1 setting image information and a light state at initial values (defaults), respectively. Then, in step 1, the control means 1 remains in a state of waiting for input until operational information is received from the operating means 4, or from the communications means 6.

When the information is input in step 1, the control means 1 attempts to acquire image information from the input information through the image information acquisition means 9 in step 2. If the image information acquisition means 9 succeeds in acquiring the image information, and, additionally, the acquired image information is different from present image information, the control means 1 causes the processing stage to proceed to step 4. If not, the control means 1 transfers the processing stage to step 3.

In step 3, the control means 1 checks whether or not the light state has been changed. If changed, the processing stage proceeds to step 4, and, if not changed, the processing stage proceeds to step 5. In other words, if either the image information or the light state has been changed, the processing stage proceeds to step 4. If neither the image information nor the light state has been changed, the processing stage proceeds to step 5.

Figure 3A:
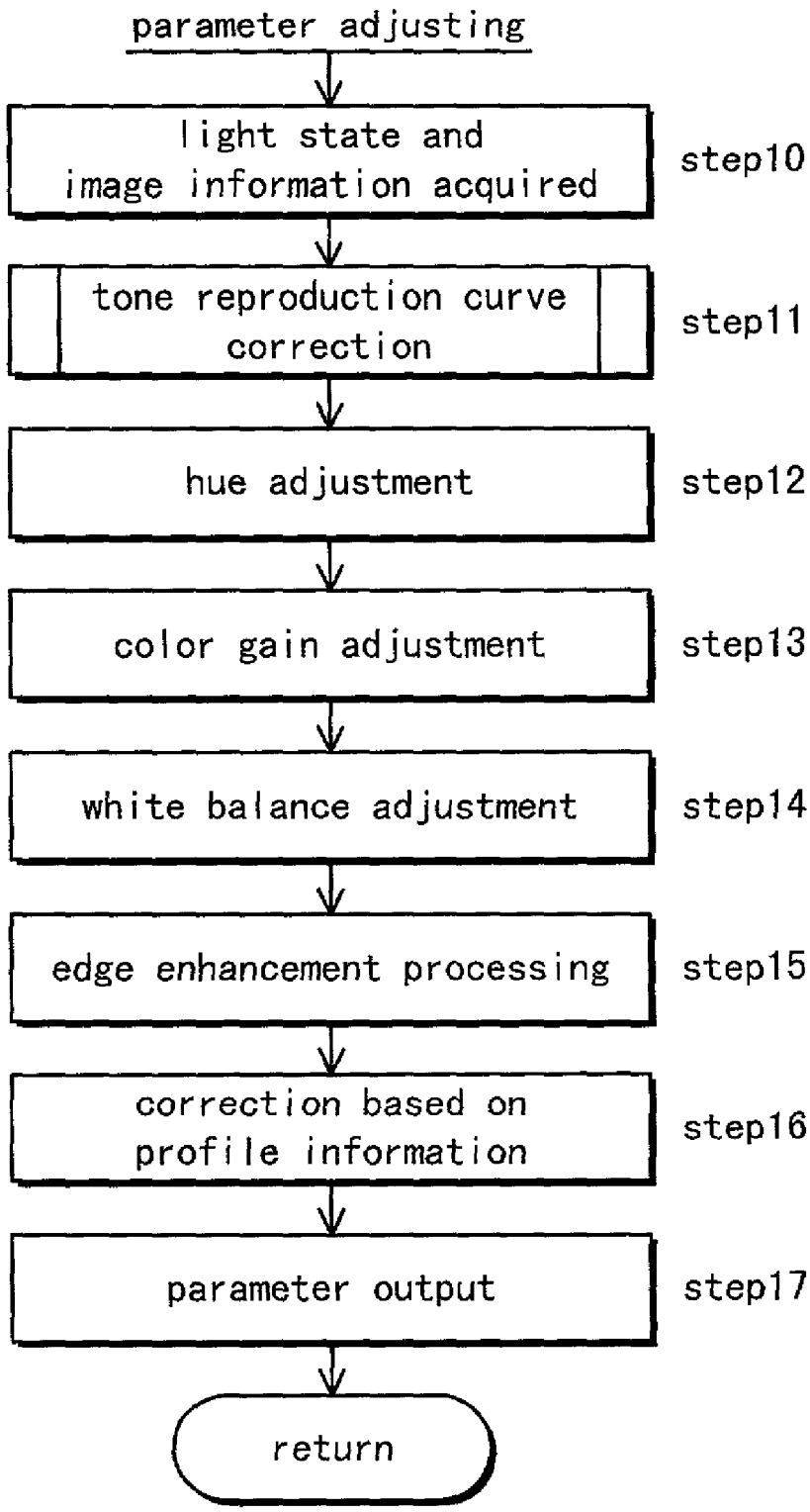
FIG. 3(*a*) and FIG. 3(*b*) are flowcharts to which reference will be made in describing a parameter adjustment according to the embodiment of the present invention.
Figure 3B:
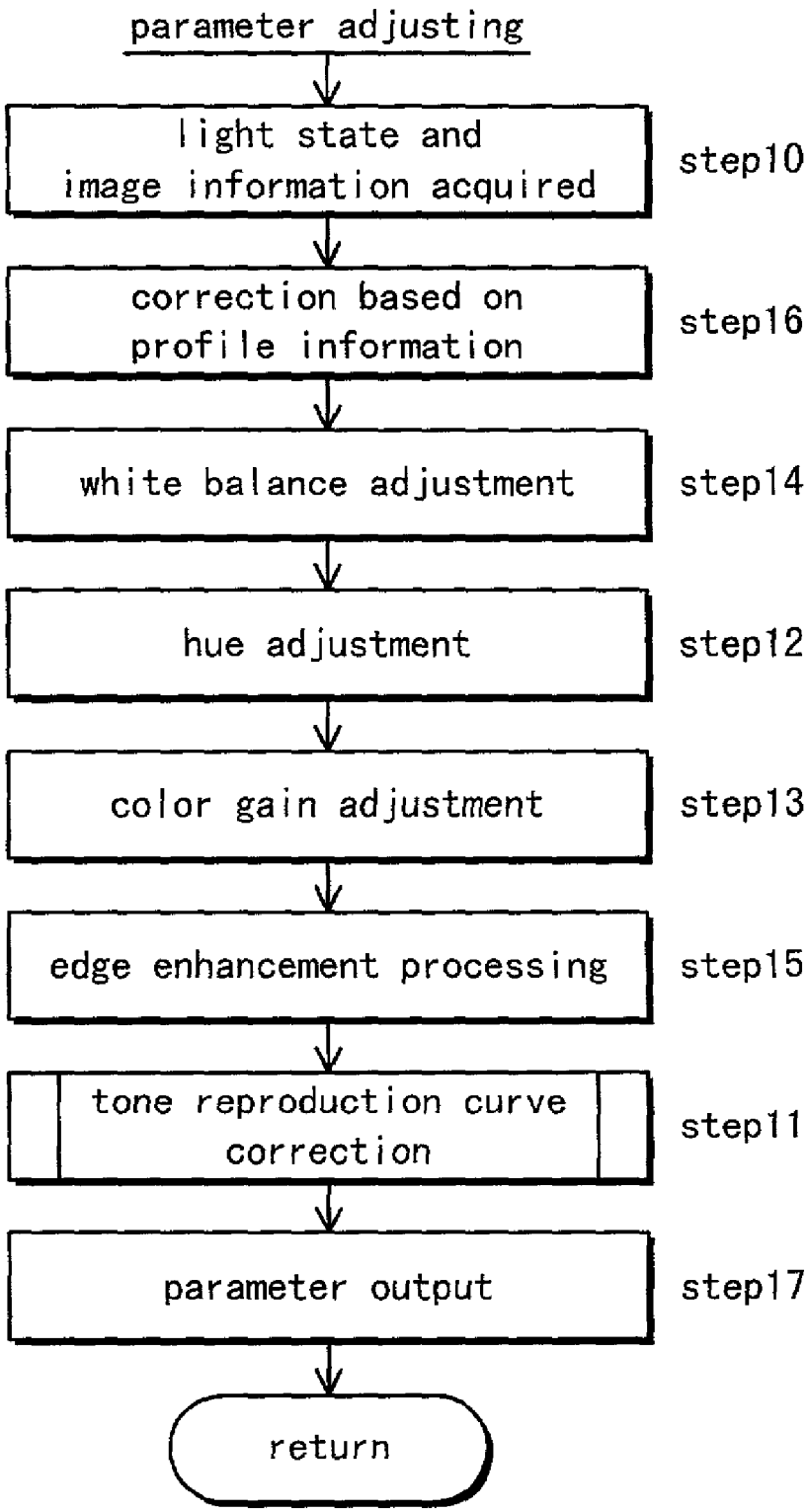
Figure 4:
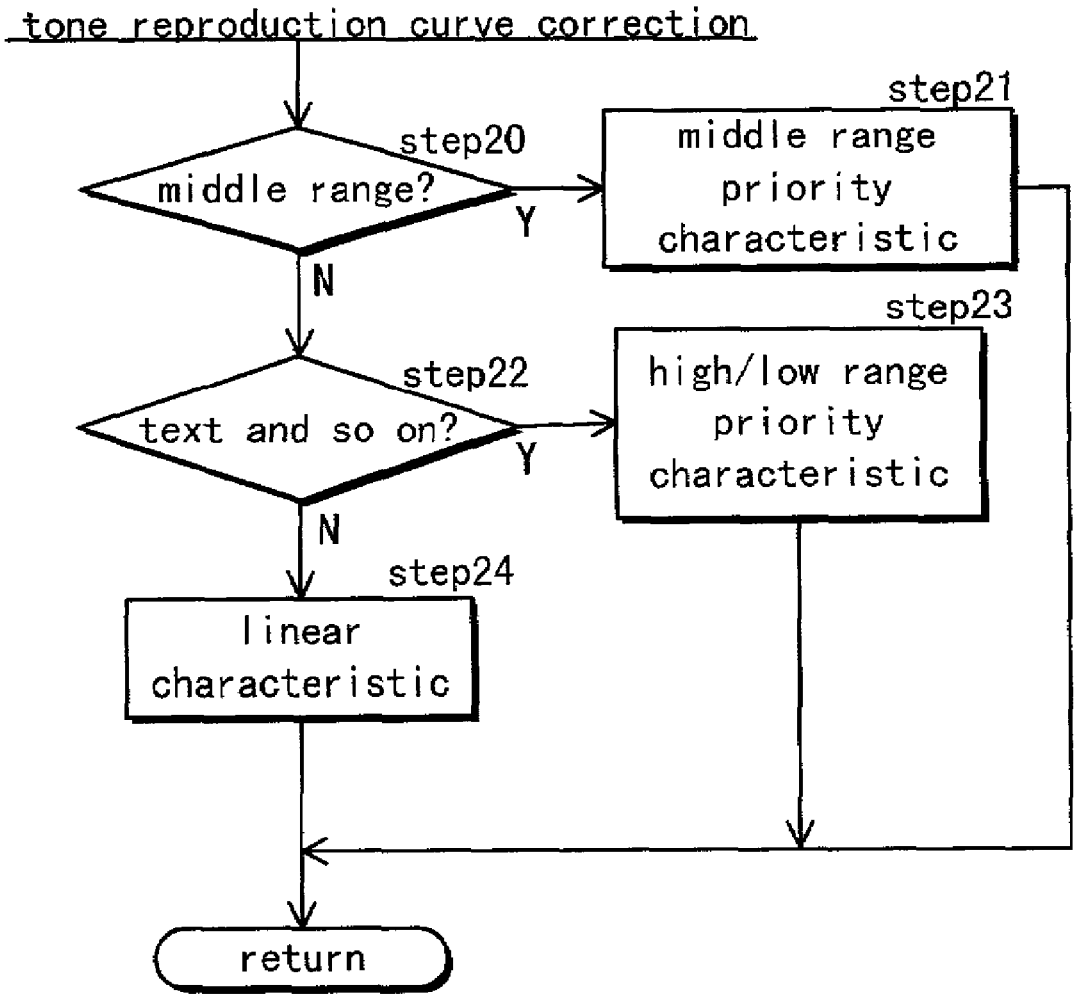
FIG. 4 is a flowchart to which reference will be made in describing tone reproduction curve correction according to the embodiment of the present invention.
Figure 5:
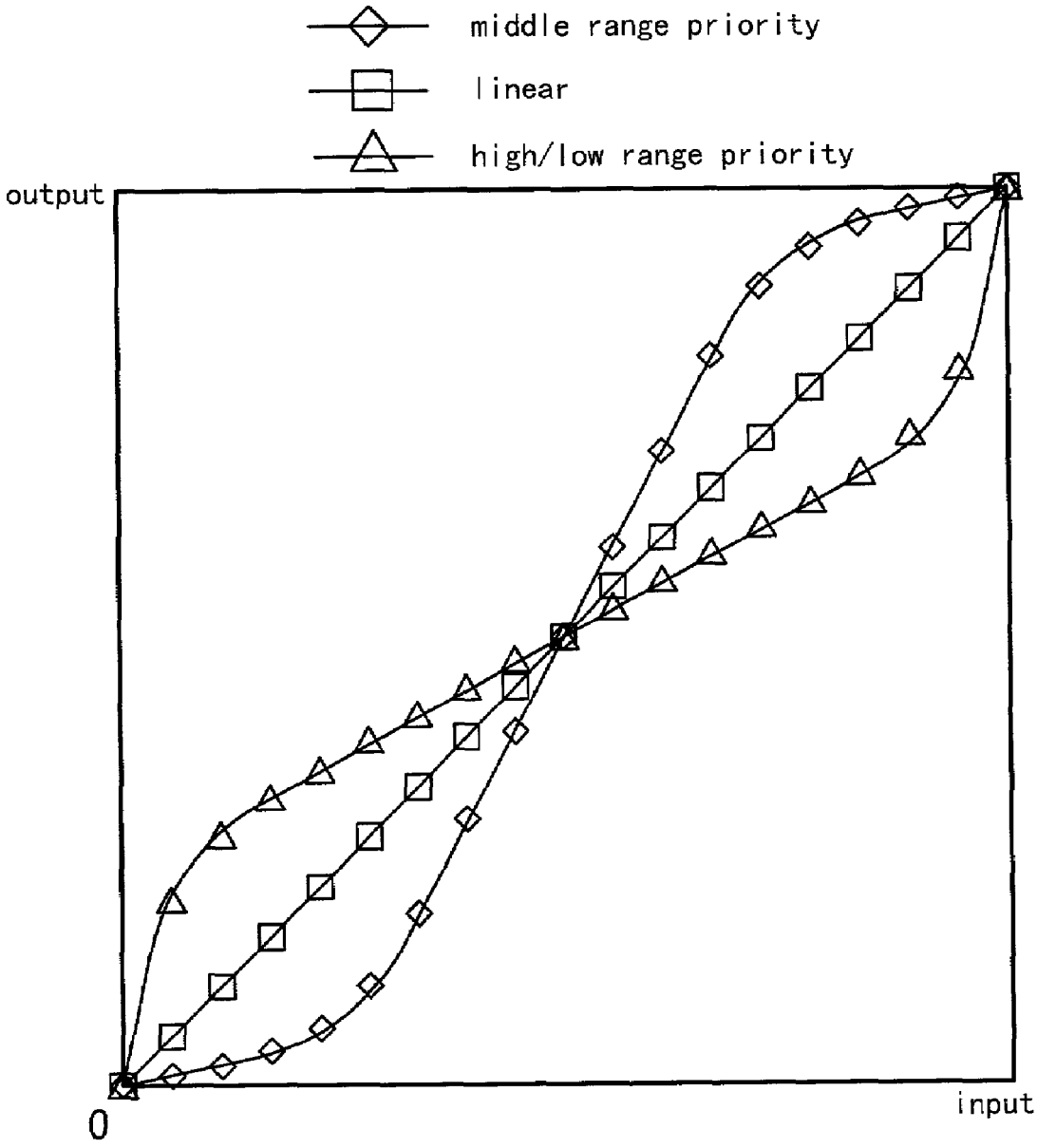
FIG. 5 is a graph that shows tone characteristics according to the embodiment of the present invention.

Referring now also to FIG. 3(*a*), in step 4, the control means 1 commands the parameter adjusting means 13 to adjust parameters. First, the parameter adjusting means 13 acquires a present light state and image information from the control means 1 in step 10. Thereafter, in step 11, the parameter adjusting means 13 performs tone reproduction curve correction as shown in FIG. 4 and FIG. 5. The tone reproduction curve correction will be described in detail later.

Thereafter, the parameter adjusting means 13 makes a hue adjustment in step 12. This is to adjust the rotating angle of a hue.

Thereafter, the parameter adjusting means 13 makes a color gain adjustment in step 13. This adjusts chroma saturation by changing the magnification of the gain of a chrominance signal.

Thereafter, the parameter adjusting means 13 makes a white balance adjustment in step 14. This adjusts the ratio of R:G:B. In this embodiment, adjustment is made of white balance suitable for the existing light state. The amount of light light is zero when turned off, and, when turned on, the light light is the amount of the present light light.

Thereafter, the parameter adjusting means 13 performs edge enhancement processing in step 15. This processing adjusts the edge of an image. Preferably, this adjustment is determined in consideration of the relationship with other parameters. For example, when an adjustment is made to increase brightness on the whole according to other parameters, an edge enhancement parameter is heightened. When an adjustment is made to become darken the image, the edge enhancement parameter is lowered.

In step 16, the parameter adjusting means 13 inquires of the control means 1 about whether there is profile information relative to a present display signal or not. Thereupon, the control means 1 checks the area 3 of the memory 2. If the area 3 contains corresponding profile information, the memory 2 supplies this information to the parameter adjusting means 13. When obtaining the profile information, the parameter adjusting means 13 more finely adjusts the picture quality on the basis of this information. As a result, a characteristic, or the like, peculiar to the external device 7 can be removed.

Finally, the parameter adjusting means 13 outputs the calculated parameter to the signal correcting means 14 in step 17. Thereafter, as shown in FIG. 1, the signal correcting means 14 corrects the display signal on the basis of this parameter. Based on the corrected display signal, the driving means 15 drives the display panel 16, and the display panel 16 displays the contents of the corrected display signal.

As shown in FIG. 2, in step 5, the control means 1 checks whether or not the state in which light is being emitted but during which operational information is not received continues for a fixed time.

If the fixed time expires without operation information being received, the control means 1 commands the light intensity varying means 11 to turn off its light. As a result, useless power consumption can be saved. Thereafter, the control means 1 returns the processing stage to proceed to step 2. Thereby, the light state has been changed, and the parameter is readjusted in accordance with the OFF in step 4.

Therefore, the display panel 16 realizes a display with picture quality conforming to the state of turning off even if a user does not carry out any operation after the automatic off, thus making it possible to always maintain a comfortably viewable, beautiful display. As a result, cases are reduced in which the user turns on the lighting means 12 only for the purpose of confirming the display contents. Therefore power saving is more satisfactorily realized.

On the other hand, in step 5, if the condition is not fulfilled, the control means 1 causes the processing stage to proceed to step 1, and returns to the state of waiting for the input.

Next, referring to FIG. 4 and FIG. 5, a detailed description is given of the tone reproduction curve correction shown in step 11 of FIG. 3(*a*). First, in this embodiment, three kinds of characteristics are prepared as shown in FIG. 5.

FIG. 5 is a graph that shows tone characteristics in the embodiment of the present invention. The horizontal axis in FIG. 5 indicates input (voltage), and the vertical axis indicates output (reflectance or transmittance of the lighting means 12).

First, the linear characteristic to which a square plot is attached is a straight line having a fixed slope. That is, the same dynamic range is secured in any part of the gradations. The linear characteristic is suitable for an image in which middle ranges and the high ranges/low ranges are evenly distributed. However, on the other hand, it can be said that the linear characteristic is a characteristic without pitch.

Second, the halftone priority characteristic to which a rhombic plot is attached has a steep incline in the half-tone part, and has a gentle incline in the high range/low range part. In other words, a great amount of dynamic ranges, that can be taken by the display panel 16, are preferentially allocated to the middle ranges, with almost all of the high ranges/low ranges being cut off. Therefore, this characteristic is suitable for an image having a great amount of middle ranges, and a fine display can be shown.

Lastly, the high range/low range priority characteristic to which a triangular plot is attached has a steep incline in the high range/low range part, with a gentle incline in the middle range part. In other words, a great amount of dynamic ranges that can be taken by the display panel 16 are preferentially allocated to the high range/low range, with almost all of the middle range cut off. Therefore, this is suitable for an image having a great amount of high ranges/low ranges, and a clear display can be shown.

In this embodiment, the tone reproduction curve correction made by the parameter adjusting means 13 is divided into three parts. In detail, the halftone priority characteristic is used for a natural image or a similar still image. Oppositely, the high range/low range priority characteristic is used for an image or a text that includes a great amount of high range/low range components. The linear characteristic is used for a dynamic image. However, the tone reproduction curve correction may be divided into two parts (i.e., for the halftone priority characteristic and for the high range/low range priority characteristic), and the halftone priority characteristic may be used for the dynamic image.

Therefore, in step 11 of FIG. 3(*a*), the parameter adjusting means 13 selects a characteristic for the tone reproduction curve correction as shown in FIG. 4. That is, in step 20, the parameter adjusting means 13 checks whether or not image information concerns a half-tone still image. If the image information indicates a half-tone still image, the halftone priority characteristic is selected in step 21. If not, the parameter adjusting means 13 checks whether or not the image information concerns a text or a lower-tone still image in step 22. If the image information concerns the text or the lower-tone still image, the high range/low range priority characteristic is selected in step 23. If not, the parameter adjusting means 13 selects the linear characteristic in step 24.

As mentioned above, the parameter adjusting means 13 selects a characteristic, and thereby picture quality is adjusted in accordance with contents.

The processing order of processes (step 10 through step 17) of the parameter adjustment shown in FIG. 3(*a*) can be variously changed. For example, the order shown in FIG. 3(*b*) can be employed. Additionally, the edge enhancement processing of step 15 may be carried out at any position as far as the edge enhancement processing is situated after "light state and image information acquisition" of step 10 and before "parameter output" of step 17.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electronic apparatus for displaying a display signal included in a file, the file comprising image information free of the display signal, the electronic apparatus comprising:

a display panel;

a display signal acquisition unit operable to obtain the display signal from the file;

an image information acquisition unit operable to obtain the image information from the file, said image information indicating whether the display signal includes a great amount of middle range components or a great amount of high range/low range components;

a lighting unit operable to light said display panel;

a parameter unit operable to generate a parameter based on the image information in combination with a light state of said lighting unit, and operable to output the generated parameter;

a signal correcting unit operable to correct the display signal using the generated parameter and operable to output the corrected display signal; and a driving unit operable to drive said display panel based on the corrected display signal.

2. The electronic apparatus as set forth in claim 1, wherein said parameter includes information used for tone reproduction curve correction.

3. The electronic apparatus as set forth in claim 1, wherein said parameter includes information about one or more of edge enhancement processing, hue adjustment, color gain adjustment, and white balance adjustment.

4. The electronic apparatus as set forth in claim 1, further comprising an area used to store profile information about a device that has generated said display signal, wherein said signal correcting unit corrects said display signal while taking this profile into account.

5. The electronic apparatus as set forth in claim 1, further comprising an operating unit that accepts operation of a user, and a control unit operable to input operational information from said operating unit, wherein when operational information is not input continuously during a fixed time, said control unit turns off said lighting unit, and, with this turn-off as a trigger, causes said parameter adjusting unit to adjust said parameter participating in picture quality so as to conform a light state.

6. An electronic apparatus according to claim 1, wherein the attribute of the display signal includes an indication of at least one of gradation and color system of the display signal.

7. An electronic apparatus comprising:

a display panel;

a lighting unit operable to light said display panel, a parameter adjusting unit operable to, with a variation in a light state of said lighting unit as a trigger, adjust a parameter participating in picture quality so as to conform said light state;

wherein said parameter includes information used for tone reproduction curve correction;

wherein said parameter includes information used for tone reproduction curve correction of at least two of a halftone priority characteristic that gives priority to a middle range and a high range/low range priority characteristic that gives priority to a high range/low range;

a signal correcting unit operable to input a display signal and to correct an input display signal in accordance with an adjusted parameter;

a driving unit operable to drive said display panel on the basis of a corrected display signal; and an image information acquisition unit operable to acquire image information about a display signal, wherein:

if acquired image information shows that the display signal includes a great amount of middle ranges, the signal correcting unit makes tone reproduction curve correction according to the halftone priority characteristic; and if acquired image information shows that the display signal includes a great amount of high ranges/low ranges, the signal correcting unit makes tone reproduction curve correction according to the high range/low range priority characteristic.

8. The electronic apparatus as set forth in claim 7, wherein said image information acquisition unit acquires image information from one or both of file extension information and file header information about said display signal.

9. An electronic apparatus comprising:

a display panel;

a lighting unit operable to light said display panel;

a parameter adjusting unit operable to, with a variation in a light state of said lighting means as a trigger, adjust a parameter participating in picture quality so as to conform said light state;

said parameter including information used for tone reproduction curve correction;

a signal correcting unit operable to input a display signal and to correct picture quality of an input display signal in accordance with an adjusted parameter; and a driving unit operable to drive said display panel on the basis of a corrected display signal;

wherein, when acquired image information shows an image that includes a great amount of halftone components, said signal correcting unit makes tone reproduction curve correction according to a halftone priority characteristic, and when acquired image information shows an image or a text that includes a great amount of high range/low range components, said signal correcting unit makes tone reproduction curve correction according to said high range/low range priority characteristic.

10. A computer-readable recording medium having stored thereon computer executable program steps operative for controlling an electronic apparatus for displaying a display signal included in a file, the file comprising file image information free of the display signal, the electronic apparatus including a display panel, a lighting unit operable to light the display panel, and a driving unit operable to drive the display panel, the program comprising:

an image information acquisition process of obtaining the image information from the file, said image information indicating whether the display signal includes a great amount of middle range components or a great amount of high range/low range components;

a parameter generating process of generating a parameter based on the image information in combination with a light state of said lighting unit, and operable to output the generated parameter a light state of said lighting unit, and operable to output the generated parameter; and a signal correcting process of correcting the display signal using the generated parameter and outputting it to the driving unit.

11. The computer-readable recording medium as set forth in claim 10, wherein the parameter includes information used for tone reproduction curve correction.

12. The computer-readable recording medium as set forth in claim 10, wherein said parameter includes information about one or more of edge enhancement processing, hue adjustment, color gain adjustment, and white balance adjustment.

13. The computer-readable recording medium as set forth in claim 10, wherein profile information about a device that has generated said display signal is stored, and said signal correcting process corrects said display signal while taking this profile into account.

14. The computer-readable recording medium recording a program as set forth in claim 10, wherein, when operational information is not input from a user continuously during a fixed time, said lighting means is turned off and, with this turn-off as a trigger, said parameter generating process generates said parameter.

15. The computer-readable recording medium as set forth in claim 10, wherein the attribute of the display signal includes an indication of at least one of gradation and color system of the display signal.

16. A computer-readable recording medium having stored thereon computer executable program steps operative for controlling an electronic apparatus that includes a display panel, a lighting unit operable to light the display panel, and a driving unit operable to drive the display panel, the program comprising:

a parameter adjusting process of, with a variation in a light state of the lighting unit as a trigger, adjusting a parameter participating in picture quality so as to conform the light state;

wherein the parameter includes information used for tone reproduction curve correction;

wherein said parameter includes information used for tone reproduction curve correction of at least two of a halftone priority characteristic that gives priority to a middle range and a high range/low range priority characteristic that gives priority to a high range/low range;

a signal correcting process of inputting a display signal and correcting an input display signal in accordance with an adjusted parameter and outputting it to the driving unit; and an image information acquisition process of acquiring image information about a display signal, wherein:

if acquired image information shows that said display signal includes a great amount of middle ranges, said signal correcting process makes tone reproduction curve correction according to said halftone priority characteristic; and if acquired image information shows that said display signal includes a great amount of high ranges/low ranges, said signal correcting process makes tone reproduction curve correction according to said high range/low range priority characteristic.

17. The computer-readable recording medium as set forth in claim 16, wherein said image information acquisition process acquires image information from one of or both of file extension information and file header information about said display signal.

18. A computer-readable recording medium having stored thereon computer executable program steps operative for controlling an electronic apparatus that includes a display panel, a lighting unit operable to light the display panel, and a driving unit operable to drive the display panel, the program comprising:

a parameter adjusting process of, with a variation in a light state of the lighting unit as a trigger, adjusting a parameter participating in picture quality so as to conform the light state;

the parameter including information used for tone reproduction curve correction; and a signal correcting process of inputting a display signal and correcting picture quality of an input display signal in accordance with an adjusted parameter and outputting it to the driving unit;

wherein, when acquired image information shows an image that includes a great amount of halftone components, said signal correcting process makes tone reproduction curve correction according to a halftone priority characteristic, and when acquired image information shows an image or a text that includes a great amount of high range/low range components, said signal correcting process makes tone reproduction curve correction according to said high range/low range priority characteristic.

* * * * *

UNITED STATES PATENT AND TRADEMARK OFFICE

CERTIFICATE OF CORRECTION

PATENT NO. : 7,317,439 B2
APPLICATION NO. : 10/045611
DATED : January 8, 2008
INVENTOR(S) : Hata et al.

It is certified that error appears in the above-identified patent and that said Letters Patent is hereby corrected as shown below:

In column 9, line 58-59, in Claim 14, after “medium” delete “recording a program”.

In column 9, line 61, in Claim 14, after “turned off” insert -- , --.

Signed and Sealed this

Eighth Day of July, 2008

JON W. DUDAS
*Director of the United States Patent and Trademark Office*